United States Patent [19]

Fenne

[11] Patent Number: 4,478,189

[45] Date of Patent: Oct. 23, 1984

[54] FUEL INJECTION SYSTEM

[75] Inventor: Ivor Fenne, Greenford, England

[73] Assignee: Lucas Industries, Birmingham, England

[21] Appl. No.: 545,672

[22] Filed: Oct. 26, 1983

[30] Foreign Application Priority Data

Dec. 8, 1982 [GB] United Kingdom ..... 8234946

[51] Int. Cl.[3] ..... F02M 39/00; F02M 59/02

[52] U.S. Cl. ..... 123/467; 123/446; 417/499; 417/569; 239/533.7; 137/538

[58] Field of Search ..... 123/467, 446, 447, 460, 123/506, 459; 239/88-95, 533.7; 417/490, 499, 569, 307; 137/538

[56] References Cited

U.S. PATENT DOCUMENTS

| | | | |
|---|---|---|---|
| 2,247,421 | 7/1941 | Tabb | 123/467 |
| 2,922,581 | 1/1960 | Garday | 417/569 |
| 3,814,122 | 6/1974 | Akaike | 417/307 |
| 3,965,876 | 6/1976 | Tissot | 123/467 |
| 4,074,668 | 2/1978 | Indra | 123/467 |
| 4,099,894 | 7/1978 | Indra | 417/499 |
| 4,351,283 | 9/1982 | Ament | 123/506 |
| 4,408,586 | 10/1983 | van Rinsom | 123/459 |

FOREIGN PATENT DOCUMENTS

| | | | |
|---|---|---|---|
| 2089888 | 6/1982 | United Kingdom | 123/446 |

*Primary Examiner*—Charles J. Myhre
*Assistant Examiner*—Carl Stuart Miller

[57] ABSTRACT

A fuel injection system for a compression ignition engine includes a high pressure fuel pump, an injection nozzle and valve means adjacent the pump. The valve means includes a first valve member spring biased to a closed position and a second valve also spring biased to a closed position. The first valve member defines an absorbing chamber which following the closure of the second valve member upon cessation of fuel flow has the pressure therein reduced. A valve element can open the absorbing chamber to the pipeline connecting the valve means to the nozzle, when a reflected pressure wave travels towards the pump from the nozzle, the reflected pressure wave being absorbed in the chamber.

7 Claims, 1 Drawing Figure

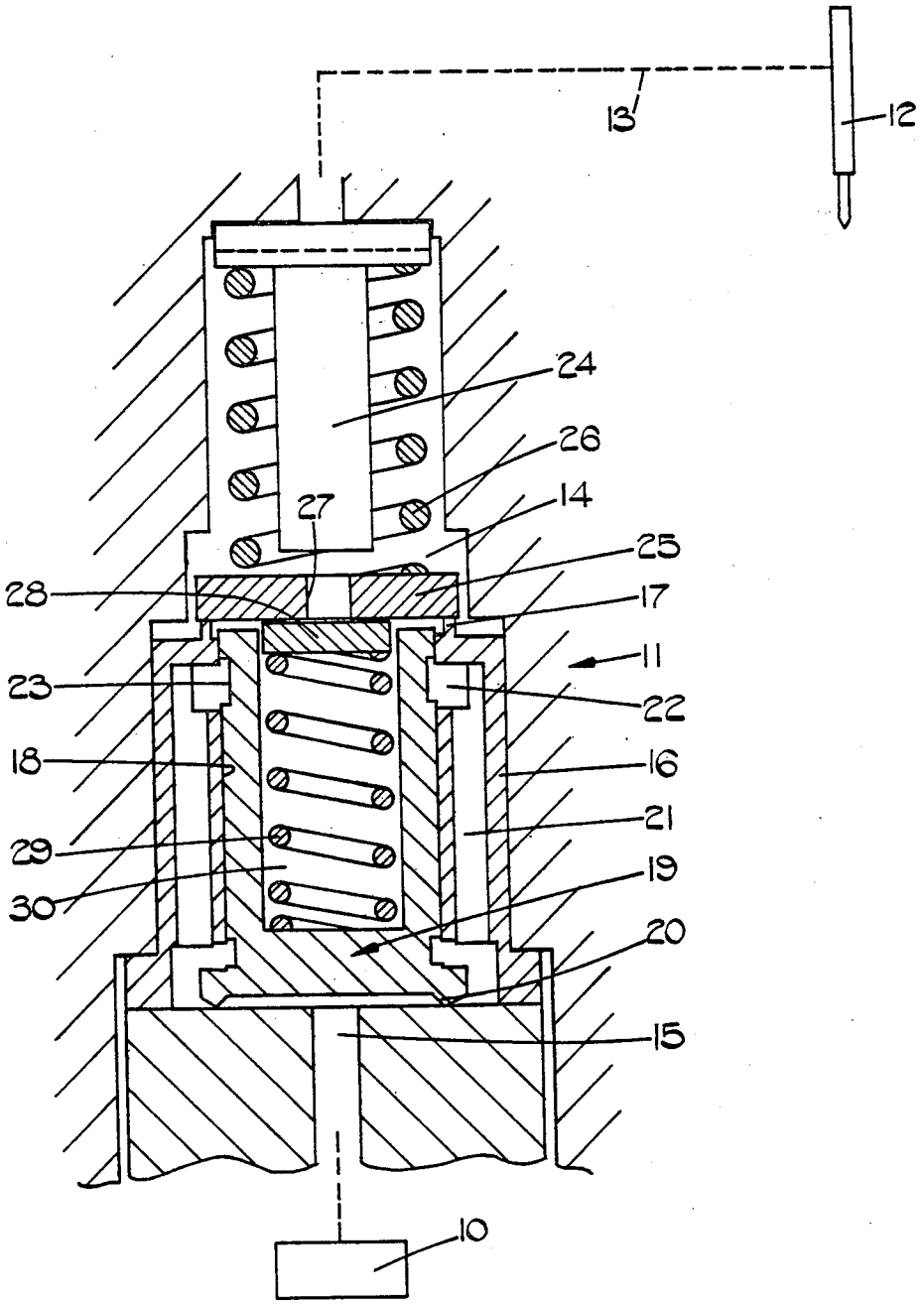
13
12
24
26
14
27
25
28
17
11
23
22
18
16
21
29
19
30
20
15
10

FUEL INJECTION SYSTEM

This invention relates to a fuel injection system for an internal combustion engine of the compression ignition type and comprising an injection nozzle having a fuel inlet and a fuel injection pump having a high pressure outlet connected to the fuel inlet of the nozzle by a pipeline, the nozzle incorporating a resiliently loaded fuel pressure actuated valve member which is lifted from a seating to allow fuel flow through an outlet of the nozzle when fuel under pressure is supplied to the nozzle by the pump.

It is conventional practice to provide adjacent the outlet of the pump a so-called delivery valve. Essentially the delivery valve is a one-way valve which is opened by the pressure of fuel supplied by the pump. When delivery of fuel ceases the valve closes to isolate the pump from the pipeline. In most cases however the delivery valve is of the unloading type which allows a limited volume of fuel to flow from the pipeline to the pump. The purpose of such flow is to reduce the pressure in the pipeline to allow the valve member of the nozzle to close quickly.

One problem with such a system is "secondary injection" which is due to the valve member of the nozzle being reopened by a reflected pressure wave. The pressure wave is generated by the closure of the valve member of the nozzle onto its seating and the wave passes down the pipeline to be reflected by the closed or closing delivery valve. In an attempt to eliminate the reflected wave, so-called snubber valves have been fitted adjacent the delivery valve on the opposite side thereof to the pump. Such valves incorporate a one-way valve and a restricted by-pass passage and although such valves can be designed to minimise the effect of the reflected pressure wave, the speed range over which they are effective is limited and depends upon the size of the orifice in the by-pass passage.

The object of the present invention is to provide a fuel injection system of the kind specified in a simple and convenient form.

According to the invention a fuel injection system of the kind specified comprises valve means disposed in or adjacent the outlet of the pump, said valve means comprising a chamber, a fuel inlet from the pump at one end of the chamber, a first valve member having seat means which in the closed position of the valve member closes said inlet, first resilient means biasing said first valve member to the closed position, a second valve member movable in said chamber, second resilient means biasing said second valve member into contact with a seating which is defined in said chamber downstream of said inlet, passage means controlled by said first valve member and which is opened after a predetermined movement of the first valve member away from said inlet, said passage means when opened allowing fuel flow from said inlet to an outlet from the chamber by way of said second valve member, an opening in said second valve member and a resiliently biased valve element controlling said opening, said opening communicating with an absorbing chamber defined by said first valve member, said valve members being positioned so that during the initial supply of fuel through said inlet the first valve member will engage the second valve member before movement of the valve members is halted by a lift stop and during closure of the valve means the first valve member will continue to move under the action of tis resilient loading after the second valve member has contacted the seating, the continued movement of the first valve member causing a reduced fuel pressure in said absorbing chamber, any pressure wave from the nozzle lifting said valve element and being absorbed in said absorbing chamber.

An example of a fuel injection system in accordance with the invention will now be described with reference to the accompanying drawing.

Referring to the drawing the system comprises a fuel pump indicated at 10, a valve means indicated generally at 11 and a fuel injection nozzle 12, the latter being connected to the valve means by way of a Pipeling 13. Conveniently the valve means is in the structure of the pump 10 although it may be provided on the exterior of the pump if this is more convenient. The nozzle is of the well known type in which a valve member is resiliently biased into contact with a seating and is lifted from the seating by the action of fuel under pressure to allow fuel flow through an outlet. The pump is of the reciprocable plunger type again will known in the art.

The valve comprises a chamber generally indicated at 14 and which has an end wall in which is formed a fuel inlet 15, the latter being connected to the outlet of the pump 10. Located in the chamber is an insert 16 which conveniently is trapped between two parts of the valve housing. The insert 16 defines a seating 17 at its end remote from the inlet and it also defines a bore 18 in which is slidable a first valve member generally indicated at 19. The first valve member is of cup-shaped form and its base wall defines an annular seat means 20 which in the closed position of the valve member as shown, engages with the portion of the body of the valve means in which the inlet 15 is formed. In the closed position of the valve member therefore the inlet 15 is closed. The insert 16 also defines a plurality of axially extending passages 21 which open into a circumferential groove 22 formed in the internal peripheral surface of the bore 18. In addition, the skirt portion of the valve member 19 defines a groove 23 which in the open position of the valve member as will be explanined, is exposed beyond the end of the insert. The extent of movement of the valve member may be limited by its abutment with the end of the insert adjacent the inlet 15 or as will be described, it may be limited by a stop member 24 located in the chamber 14.

For co-operation with the seating 17 there is provided a second valve member 25 of plate like form and this is biased into contact with the seating by means of a compression spring 26. The valve member 25 is provided with a central opening 27 and this is controlled by a plate valve element 28, the element 28 being biased into contact with the valve member 25 by means a so-called absorbing chamber 30 defined by the first valve member 19. The force exerted by the spring 29 is less than that exerted by the spring 26 so that in the rest position as shown, the second valve member 25 is maintained in contact with the seating 17.

In operation, when fuel under pressure is supplied by the pump 10, the pressure of fuel acting on the end of the valve member lying within the confines of the seat means 20, lifts the first valve member against the action of the spring 29. As a result of this movement fuel will be displaced towards the second valve member 25 which will be lifted from the seating 17 to permit fuel flow to the pipeline 13 and hence the nozzle 12.

As the fuel continues to be supplied by the pump 10, the first valve member 19 will continue to move in effect against the action of the two springs in series. Such movement will continue until either the stop 24 is contacted by the valve member 25 or the movement of the first valve member is halted by its abutment with the insert. In each case when the movement of the valve members is halted the groove 23 will be exposed beyond the end of the insert and hence the flow of fuel to the nozzle takes place by way of the passages 21 and the grooves 22 and 23.

When the supply of fuel by the pump 10 ceases, the springs will urge the valve members towards the positions shown the drawing. During the initial Part of such movement the two valve members are in engagement with each other and hence a predetermined volume of fuel will flow back towards the pump 10 before the second valve member 25 contacts the seating. The predetermined volume of fuel is of course determined by the fact that the first valve member acts as a piston once the groove 23 has been covered by the end of the insert. When the valve member 25 contacts the seating, continued movement of the first valve member 19 can take place under the action of the spring 29. Such movement causes a reduction in the pressure in the absorbing chamber 30 and the reduction in pressure is desirably sufficient to draw a cavity in the absorbing chamber. The stength of the spring 29 is however sufficient to prevent the valve element 28 lifting away from the valve member 25. Such movement however can take place when the pressure wave originating in the nozzle 12, is dissipated in the absorbing chamber 30.

The valve means as described is effective at both low and high speeds to absorb the pressure wave. Moreover, the valve means is still effective to inload a predetermined volume of fuel from the pipeline 13 to assist the rapid closure of the nozzle 12.

I claim:

1. A fuel injection system for an internal combustion engine of the compression ignition type comprising an injection nozzle having a fuel inlet and a fuel injection pump having a high pressure outlet connected to the fuel inlet of the nozzle by a pipeline, the nozzle incorporating a resiliently loaded fuel pressure actuated valve member which is lifted from a seating to allow fuel flow through an outlet of the nozzle when fuel under pressure is supplied to the nozzle of the pump, valve means disposed in or adjacent the outlet of the pump, said valve means comprising a chamber, a fuel inlet from the pump at one end of the chamber, a first valve member having seat means which in the closed position of the valve member closes said inlet, first resilient means biasing said first valve member to the closed position, a second valve member movable in said chamber, second resilient means biasing said second valve member into contact with a seating which is defined in said chamber downstream of said inlet, passage means controlled by said first valve member and which is opened after a predetermined movement of the first valve member away from said inlet, said passage means when opened allowing fuel flow from said inlet to an outlet from the chamber by way of said second valve member, an opening in said second valve member and a resiliently biased valve element controlling said opening, said opening communicating with an absorbing chamber defined by said first valve member, said valve members being positioned so that during the initial supply of fuel through said inlet the first valve member will engage the second valve member before movement of the valve members is halted by a lift stop and during closure of the valve means the first valve member will continue to move under the action of its resilient loading after the second valve member has contacted the seating, the continued movement of the first valve member causing a reduced fuel pressure in said absorbing chamber, any pressure wave from the nozzle lifting said valve emement and being absorbed in said absorbing chamber.

2. A fuel system according to claim 1 in which said first valve member is of cup-shaped form, the base wall thereof defining said seat means, the first resilient means comprising a coiled compression spring located within the space defined by the skirt of the valve member, said space defining said absorbing chamber.

3. A fuel system according to claim 2 in which said first valve member is slidable within a bore, said passage mens including a circumferential groove in the skirt of the first valve member, the groove in the skirt being uncovered beyond the end of the bore to allow said fuel flow when the first valve member has moved through said predetermined movement.

4. A fuel system according to claim 3 including a further groove in the wall of said bore, said further groove being a constant communication with said first mentioned groove and communicating with said inlet when the inlet has been uncovered by the first valve member.

5. A fuel system according to claim 2 in which said valve element is biased to the closed position by said first resilient means.

6. A fuel system according to claim 1 in which said lift stop is positioned for engagement by said second valve member.

7. A fuel system according to claim 4 in which said further groove communicates with a passage forming part of said passage means, said passage being formed in a part defining said bore.

* * * * *